US009683787B2

(12) United States Patent
Stroganov et al.

(10) Patent No.: US 9,683,787 B2
(45) Date of Patent: Jun. 20, 2017

(54) DEVICE FOR FLUID POWER RECUPERATION

(76) Inventors: Alexander Anatolyevich Stroganov, St. Petersburg (RU); Leonid Olegovich Sheshin, St. Petersburg (RU)

( * ) Notice: Subject to any disclaimer, the term of this patent is extended or adjusted under 35 U.S.C. 154(b) by 481 days.

(21) Appl. No.: 13/806,514

(22) PCT Filed: Oct. 1, 2010

(86) PCT No.: PCT/RU2010/000575

§ 371 (c)(1),
(2), (4) Date: Dec. 21, 2012

(87) PCT Pub. No.: WO2012/008867

PCT Pub. Date: Jan. 19, 2012

(65) Prior Publication Data

US 2013/0133853 A1 May 30, 2013
US 2016/0363383 A9 Dec. 15, 2016

Related U.S. Application Data

(63) Continuation-in-part of application No. 13/257,231, filed as application No. PCT/RU2010/000056 on Feb. 9, 2010, now Pat. No. 8,646,484.

(30) Foreign Application Priority Data

May 18, 2009 (RU) ..... 2009119442
Jul. 13, 2010 (RU) ..... 2010129792

(51) Int. Cl.
*F23L 15/02* (2006.01)
*F28D 17/02* (2006.01)
*F15B 1/02* (2006.01)

(52) U.S. Cl.
CPC ..... *F28D 17/02* (2013.01); *F15B 1/024* (2013.01); *F15B 2201/3151* (2013.01);
(Continued)

(58) Field of Classification Search
CPC ..... F15B 2201/205; F15B 2201/315; F15B 2201/3151; F15B 2201/3154; F15B 2201/405; F15B 2201/42; F28D 20/02
(Continued)

(56) References Cited

U.S. PATENT DOCUMENTS 3,660,784 A * 5/1972 Scharfman ..... 333/22 F
4,018,052 A * 4/1977 Laussermair ..... B60K 6/105 475/267

(Continued)

FOREIGN PATENT DOCUMENTS

AT 197 219 B 4/1958
AU 39279 78 A 3/1980

(Continued)

OTHER PUBLICATIONS

Stolbov, et al.; "Fundamentals of Hydraulics and Hydraulic Drive of Machines"; Moscow, Mashinostroenie; 1988; p. 170-177.

(Continued)

*Primary Examiner* — Len Tran
*Assistant Examiner* — Gustavo Hincapie Serna
(74) *Attorney, Agent, or Firm* — Walker & Jocke; Ralph E. Jocke

(57) ABSTRACT

A device for fluid power recuperation includes at least one hydropneumatic accumulator having a shell. The shell contains a fluid port communicating with a fluid reservoir of the accumulator that is separated from a gas reservoir of the accumulator by a movable separator. The gas reservoir of the accumulator communicates via a gas port with at least one gas receiver containing a regenerating heat exchanger made in the form of a metal porous structure. The aggregate area of the heat exchange surfaces of the regenerating heat exchanger over the aggregate internal receiver volume exceeds 2000 $cm^2$/liter, preferably exceeds 10000 $cm^2$/liter.

23 Claims, 1 Drawing Sheet

(52) U.S. Cl.
CPC ..... *F15B 2201/3152* (2013.01); *F15B 2201/3153* (2013.01); *F15B 2201/42* (2013.01)

(58) Field of Classification Search
USPC ..... 165/4, 10; 60/413, 410, 414; 138/30, 31
See application file for complete search history.

(56) References Cited

U.S. PATENT DOCUMENTS

| | | | | |
|---|---|---|---|---|
| 4,760,697 | A * | 8/1988 | Heggie | B60K 6/12 180/165 |
| 4,981,172 | A * | 1/1991 | Haerle | 165/133 |
| 5,579,640 | A * | 12/1996 | Gray, Jr. | B60K 6/12 60/413 |
| 6,182,717 | B1 * | 2/2001 | Yamashita | 141/82 |
| 6,405,760 | B1 | 6/2002 | Tranter et al. | |
| 6,432,176 | B1 * | 8/2002 | Klos et al. | 96/117.5 |
| 6,880,619 | B1 | 4/2005 | Suzukawa et al. | |
| 2004/0211548 | A1 * | 10/2004 | Berchowitz et al. | 165/10 |
| 2005/0194154 | A1 * | 9/2005 | Hester | 172/1 |
| 2006/0179835 | A1 * | 8/2006 | Qiu | F28D 17/02 60/521 |
| 2007/0039712 | A1 * | 2/2007 | Lang et al. | 165/10 |
| 2008/0060711 | A1 * | 3/2008 | Kort | 138/31 |
| 2008/0185909 | A1 * | 8/2008 | Walker | B60K 6/12 303/152 |
| 2010/0050622 | A1 | 3/2010 | Stroganov | |
| 2011/0120107 | A1 * | 5/2011 | Schwark et al. | 60/327 |

FOREIGN PATENT DOCUMENTS

| | | | | |
|---|---|---|---|---|
| DE | 3920030 | A1 * | 12/1989 | B60K 6/12 |
| EP | 0 942 194 | A1 | 9/1999 | |
| JP | 07232635 | A * | 9/1995 | B60K 25/00 |
| JP | 2002181295 | * | 6/2002 | |
| KR | 2010 0073732 | A | 7/2010 | |

OTHER PUBLICATIONS

Exner, et al.; "Hydraulic Drive. Fundamentals and Components. 2nd Russian edition."; Bosch Rexport AG Service Automation Didactics Erbach; Germany; 2003; p. 156.

Stroganov, et al.; "Honeycomb Receiver as an Accumulator Shell: Significant Reduction of Danger and Thermal Losses"; Proceedings of the 11th Scandinavian International Conference on Fluid Power; SICFP'09; Jun. 2, 2009; Linköping, Sweden.

Stroganov, et al.; "Efficient, Safe and Reliable Recuperation: Regenerative Accumulator in Honeycomb Receiver"; Proceedings of the 7th International Fluid Power Conference; Mar. 22, 2010; Aachen, Germany.

European Patent Office, "Notification of Transmittal of the International Search Report and the Written Opinion of the International Searching Authority, or the Declaration", Jun. 9, 2011.

* cited by examiner

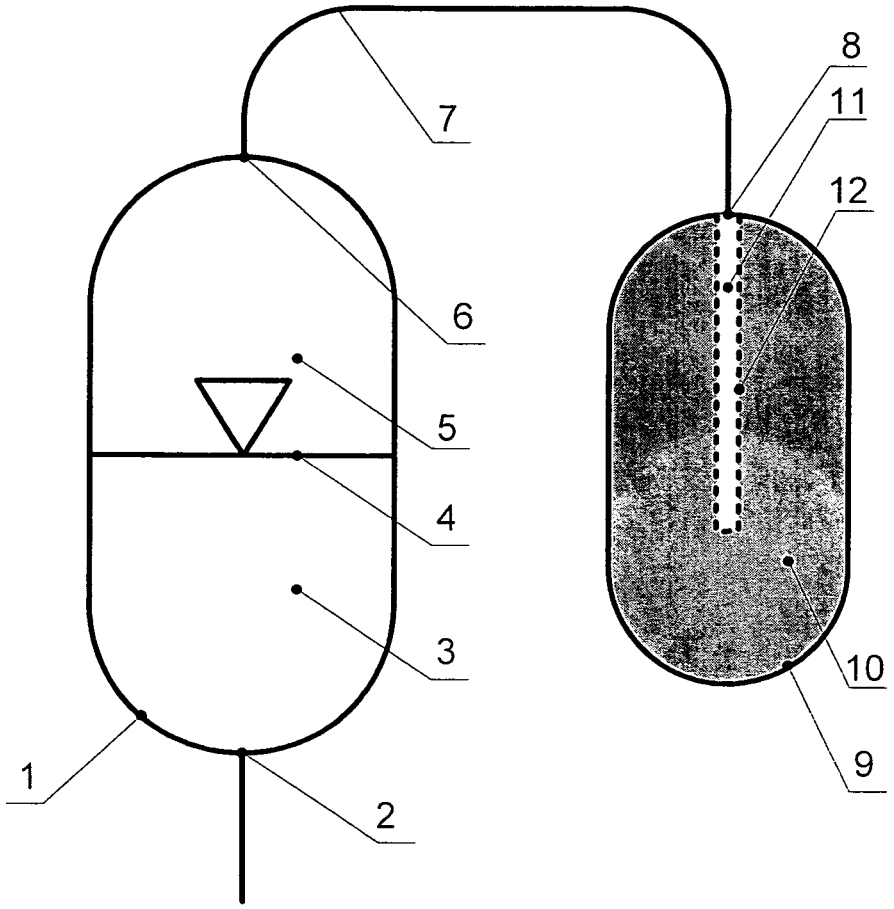
7
8
11
12
6
5
4
3
10
9
1
2

DEVICE FOR FLUID POWER RECUPERATION

CROSS-REFERENCE TO RELATED APPLICATIONS

This application is a continuation-in-part of U.S. application Ser. No. 13/257,231 having a filing date pursuant to 35 USC §371 on Sep. 16, 2011, which corresponds to PCT Application PCT/RU2010/000056 filed Feb. 9, 2010 (now U.S. Pat. No. 8,646,484) which claims foreign priority of Russian Federation Application 2009 119442 filed May 18, 2009.

TECHNICAL FIELD

The invention refers to mechanical engineering and can be used for more efficient and safer fluid power recuperation, including mobile applications, such as road-building machines, carrying and lifting equipment as well as hydraulic hybrid trucks and motorcars.

BACKGROUND ART

There are devices for fluid power recuperation in the form of hydropneumatic accumulators (hereinafter—accumulators), their shells containing a variable volume gas reservoir filled with pressurized gas via a gas port as well as a variable volume fluid reservoir filled with fluid via a fluid port; while these gas and fluid reservoirs are separated by a separator movable relative to the shell.

Fluid power recuperation is performed using accumulators both with a solid separator in the form of a piston and elastic separators, for example, in the form of elastic polymer membranes or bladders as well as in the form of metal bellows.

Before operation the gas reservoir of the accumulator is charged via the gas port with pressurized gas, generally, with nitrogen, up to the initial pressure from several to dozens MPa.

During power transfer from the fluid power system to the accumulator (at in hydraulic hybrid vehicle braking, for example) the pumping of the working fluid from the fluid power system into the accumulator occurs as well as working gas compression within the accumulator, with a gas pressure increase and a temperature increase. During power return from the accumulator into the fluid power system (at acceleration of the hydraulic hybrid vehicle, for example) the pressurized working gas expands and displaces the working fluid into the fluid power system.

As a rule, an accumulator contains one gas reservoir and one fluid reservoir with equal gas and fluid pressures in them. The higher the hydraulic power transferred to the accumulator, the higher the gas compression ratio in it. To maintain the required recuperated power the pressure increase has to be compensated by reduced delivery of the hydraulic machine (a pump or a motor) hydraulically connected with the accumulator. As the delivery is reduced, the hydraulic machine efficiency drops; hence, the total recuperation efficiency drops, which is a disadvantage of such devices.

An increased volume of the accumulator or an increased number of accumulators for gas compression ratio reduction raises the cost of the system, as well as makes it heavier. Weight is critical for mobile applications.

A well-known device is used to reduce gas compression ratio and, at the same time, to increase the maximum possible recuperated power. The device includes a hydropneumatic accumulator, its shell containing a fluid port communicating with the fluid reservoir of the accumulator separated by a movable separator from the gas reservoir of the accumulator that communicates with at least one gas receiver via a gas port.

When the working fluid is pumped from the fluid power system into the fluid reservoir of the accumulator, the separator is displaced and forces the gas out of the accumulator into the receiver, compressing the gas in the receiver and in the accumulator. The work of pumping the fluid into the accumulator is transformed into internal energy of the pressurized gas, its pressure and temperature increasing. When the power returns from the device into the fluid power system, the pressurized working gas expands and is partially forced out of the receiver into the gas reservoir of the accumulator. The separator is displaced, the volume of the fluid reservoir of the accumulator decreases and the working fluid is forced out of the fluid reservoir into the fluid power system via the fluid port. The internal energy of the pressurized gas is transformed into the work of the fluid displacement, i.e. the device returns the fluid power received from the fluid power system back into the system, with the gas pressure and temperature decreasing.

The addition of the receiver that is lighter and cheaper than the accumulator to the system allows increasing the amount of the recuperated power at the expense of better use of the accumulator volume and reducing gas compression ratio and, accordingly, the range of variation of the delivery of the hydraulic machines operating in the system, which increases the recuperation efficiency.

A shortcoming of the devices used for fluid power recuperation is the high level of heat losses due to the fact that when compressed and expanded the gas in the receiver exchanges its heat only with the internal walls of the receiver, the distance between such walls for typical receiver volumes (units and dozens of liters) being too large (dozens and hundreds mm) and the gas heat conductivity being too small.

At such distances the gas heat exchange with the receiver walls caused by the gas heat conductivity is insignificant. Therefore, the gas compression and expansion processes are essentially non-isothermal and there emerge considerable temperature gradients of dozens and even hundreds degrees in the receiver. Considerable temperature differentials in a large receiver volume generate convective flows increasing the heat transfer to its walls dozens and hundreds times. Therefore, the gas heated during compression in the receiver and partially in the accumulator, cools down, which results in reduced pressure of the gas and increased accumulated power losses during storage of the accumulated power (for example, when the hydraulic hybrid vehicle stops). The non-equilibrium heat transfer processes in case of high temperature differentials are irreversible, i.e. the greater part of the heat transferred from the pressurized gas to the receiver walls cannot be returned to the gas during expansion. Thus, when the gas expands, the amount of the fluid power returning to the fluid power system is much less than the amount received during gas compression.

Therefore, the above described device has low efficiency of the recuperated fluid power due to high heat losses.

The device of fluid power recuperation which may be the closest analog to the present innovation includes at least one hydropneumatic accumulator communicating with at least one gas receiver (gas bottle) via its gas port. The gas receiver is made in the form of aggregate of cells communicating with the gas port of the accumulator. For higher safety the cells have strong walls with considerable thermal capacity exceeding the thermal capacity of the gas in the receiver. The receiver cells are made in the form of narrow channels (tubes) so that the ratio between the receiver volume and the area of the internal surfaces of the cells does not exceed 10 mm, which both reduces the kinetic energy of the gas jet in case of cell shell destruction and increases the heat exchange between the gas and walls of the cells considerably. Thus, the walls of the cells in said receiver perform the function of a regenerating heat exchanger taking heat from the gas during compression and returning the heat to the gas during expansion, thus ensuring lower heat losses of the devices. The closer the walls of the cells to one another, i.e. the smaller the cross dimensions of the cells, the more efficient the heat exchange between them and the gas and the higher the recuperation efficiency. However, a shortcoming of the proposed device is the difficulty of manufacturing of the receiver in the form of a strong honeycomb structure, especially with small size cells necessary for higher heat exchange capacity with the growing recuperation rate. In addition, the proposed honeycomb structures are poorly compatible with commercial gas receivers of the most common type, i.e. made with solid cylindrical shells with rounded ends, the holes in them being much smaller than the diameters of internal chambers of the receivers.

SUMMARY

An objective of the present invention is creation of a device for fluid power recuperation with reduced heat losses and increased efficiency of fluid power recuperation combined with better manufacturability and possibility of using off-the-shelf gas receivers (bottles) of various types in the device.

The objective is achieved by a device for fluid power recuperation that comprises at least one hydropneumatic accumulator, containing in its shell a fluid port communicating with the fluid reservoir of the accumulator separated from the gas reservoir of the accumulator by a movable separator. The gas reservoir of the accumulator communicates via a gas port with at least one gas receiver containing a regenerating heat exchanger made in the form of a metal porous structure, while the aggregate area of the heat exchange surfaces of the regenerating heat exchanger over the aggregate internal receiver volume exceeds 2000 $cm^2$/liter, and preferably exceeds 10 000 $cm^2$/liter.

Thus, at gas compression or expansion in the receiver the heat exchange between the gas and the regenerating heat exchanger occurs at small average distances between the gas and the heat exchange surfaces and on a large heat exchange area and, therefore, with smaller temperature differentials, which increases reversibility of the heat exchange processes and recuperation efficiency. To achieve smallness of the average distance between the gas and the heat exchange surfaces necessary for effective heat exchange, the regenerating heat exchanger is preferably made with the average pore size below 5 mm (here and hereafter the pore size of a pore means the diameter of a sphere that can be placed in this place of the pore, and the average pore size means said pore size value averaged throughout the volume of the porous structure). To reduce the gas-dynamic resistance of the metal porous structure the regenerating heat exchanger should be preferably embodied with the average pore size of at least 0.05 mm. The aggregate volume of the material of the regenerating heat exchanger should be preferably in the range from 10% to 50% of the internal receiver volume. With said share of the receiver volume occupied by the metal of the regenerating heat exchanger, the thermal capacity of the latter exceeds the thermal capacity of the gas in the receiver. For example, the specific thermal capacity of the regenerating heat exchanger made from steel will be from 400 to 2000 kJ/K/$m^3$ while the thermal capacity of the gas (nitrogen) at working pressures of 100-300 bar (and the temperature of about 300 K) is from 120 to 360 kJ/K/$m^3$. The higher the gas working pressure, the higher the thermal capacity of the regenerating heat exchanger must be, i.e. the larger the share of the receiver volume occupied by the material having such porous structure uniformly distributed in the receiver volume. Thus smallness of the average temperature variations and low long-storage losses are ensured.

A metal (steel or aluminum, for instance) porous structure can be made from ready metal items to be disposed, for example, or from metal-working production wastes.

In a preferred embodiment of the device in terms of cost, the metal porous structure is formed from turnings or metal cuttings resulting from another process of metal machine work (drilling, milling cut operation, etc.). To increase thermal capacity and vibration resistance these metal turnings or other cuttings inside the receiver can be additionally compacted.

In other embodiments the metal porous structure can be formed from metal wool or metal foam.

To prevent possible passage of particles or other fragments of the metal porous structure of the regenerating heat exchanger from the gas receiver via its gas port the latter is provided with a blocking element. To reduce the gas-dynamic resistance the axial length of the blocking element exceeds 20% of the axial length of the receiver.

The objective of increasing the manufacturability of the device with the use of various types of the off-the-shelf gas receivers can be fulfilled when the metal porous structure of the regenerating heat exchanger is formed inside the ready shell of the receiver by loading the components forming this structure (chips, wool, metal foam pieces, etc.) through holes in the receiver shell. It is also possible to use receivers made, as in the closest analog, in the form of a set of cells (tubes) with solid walls additionally containing regenerating heat exchangers in the form of the metal porous structures described above.

BRIEF DESCRIPTION OF THE DRAWINGS

The invention is described in more detail in the example given below and illustrated by the drawing presenting:

FIG. 1 is a schematic representation of the device for fluid power recuperation with one accumulator and one receiver containing a regenerating heat exchanger, axial section of the receiver.

DETAILED DESCRIPTION

The device for fluid power recuperation in FIG. 1 includes a hydropneumatic accumulator 1. The accumulator 1 includes a shell, which contains a fluid port 2 communicating with the fluid reservoir 3 of the accumulator. The fluid reservoir 3 is separated by a movable separator 4 from a gas reservoir 5 of the accumulator that communicates via a gas port 6 and a gas line 7 with the gas port 8 of a receiver 9.

The receiver 9 has a regenerating heat exchanger 10. To ensure good heat exchange between the gas and the regenerating heat exchanger, the aggregate area of the heat exchange surfaces of the regenerating heat exchanger reduced to (e.g. over) the aggregate internal receiver volume exceeds 2000 $cm^2$/liter, preferably exceeds 10000 $cm^2$/liter.

To ensure high efficiency of the heat exchange between the gas and the regenerating heat exchanger, the latter is preferably embodied so that the average distances between the gas and its heat exchange surfaces are small, namely its average pore size should not exceed 5 mm. To reduce gas-dynamic losses during gas flow through the metal porous structure of the regenerating heat exchanger, the latter is preferably embodied with small gas-dynamic resistance, namely so that its average pore size is not less than 0.05 mm.

The gas port 8 of the receiver 9 is provided with a blocking element 11 to prevent possible passage of particles or other fragments of the metal porous structure of the regenerating heat exchanger from the gas receiver via its gas port. The blocking element 11 according to FIG. 1 is made in the form of a metal cup with perforated bottom and walls with a filtering element 12 installed in it that is permeable for gas and impenetrable for particles with the size bigger than the reference one. For embodiments with a piston accumulator, the filtering element 12 is made to trap small abrasive particles that accelerate the wear of the accumulator piston seals. The filtering element preferably traps particles that are sized over 5 microns. In the embodiment according to FIG. 1, the filtering element 12 is made from a fabric. In other embodiments, the filtering element 12 can include filtering elements made from foamed ceramic or metal foam with small pores, preferably less than 5 microns. For embodiments with elastic separators of accumulators, the requirements to the size of the particles trapped by the blocking element 11 can be less strict. To reduce gas-dynamic losses during gas flow through the metal porous structure of the regenerating heat exchanger, the blocking element can be made deeply penetrating into this structure, namely so that the axial length of the blocking element should exceed 20% of the axial length of the receiver.

In an embodiment preferred in terms of simplicity of its introduction, the metal porous structure of the regenerating heat exchanger is formed inside the ready shell of the receiver by loading the components making this structure through the hole in the receiver shell. This embodiment allows assembling recuperation devices using off-the-shelf standard receivers (gas bottles) by loading the necessary amount of the components of the metal porous structure into them. An additional advantage of this embodiment is the possibility of increasing efficiency of the already functioning recuperation device containing a receiver.

In addition, it is possible to use honeycomb-structured gas bottles (for example, embodied in the form of a set of cells with solid walls made by extrusion molding or with cells in the form of separate tubes) additionally containing regenerating heat exchangers in the form of the aforesaid metal porous structures improving heat exchange and ensuring additional increase of fluid power recuperation efficiency. In such a variant, the technology of manufacturing a honeycomb receiver providing higher safety can be also simplified by reducing the number of the cells and increasing their internal size.

In the device embodiment preferable in terms of cost, the metal porous structure is formed from metal turnings. The type of turnings depends on the method of turning of the part (turning of the metal element along the outer or inner cylindrical generatrix, flat or conical face). In terms of heat exchange efficiency, it is preferable to use turnings resulting from face or conical turning.

Besides, in manufacturing porous structure of the regenerating heat exchanger, it is possible to use cuttings resulting from another process of metal machine work, for example, milling cut operation, press forging wastes as well as metal wool, wires, separate metal elements or metal foam (loaded into the receiver by separate pieces or created inside the receiver by a chemical or another method). In addition, it is possible to use metal items of required sizes to be disposed after use (for example, caps, cartridges, washers, springs, etc.).

Metal cuttings or other components of the metal porous structure inside the receiver (for example, metal elements, wool or metal foam pieces) can be additionally compacted as they are loaded into the receiver. The result is a uniform porous regenerating element with high thermal capacity and resistance to receiver vibration and gas circulation both during operation of the device and during its preliminary gas charging or discharging.

For fluid power recuperation in the device the accumulator 1 is connected with the fluid power system via its fluid port 2.

When energy is transferred from the fluid power system into the device, the fluid from the fluid power system is pumped into fluid reservoir 3 of the accumulator 1 via its fluid port 2, the separator 4 is displaced reducing the volume of the gas reservoir 5 and forcing some part of the gas into the receiver 9, thus increasing the gas pressure and temperature in the gas reservoir 5 of the accumulator 1 and in the receiver 9. Due to the small average distances between the gas and the heat exchange surfaces of the regenerating heat exchanger 10 in the receiver 9 and its high thermal capacity, the gas flowing into the receiver from the gas reservoir of the accumulator effectively gives away some heat to the regenerating heat exchanger 10, which reduces the gas heating ratio during compression; while the gas heat exchange with the regenerating heat exchanger 10 is reversible at small temperature differentials between it and the gas.

During storage of the fluid power accumulated in the device the heat losses are small as the decreased gas heating ratio reduces the heat transfer to the walls of the receiver 9 casing due to the gas heat conductivity.

When energy returns from the device into the fluid power system the pressurized gas in the receiver 9 and the gas reservoir 5 of the accumulator 1 expands, the separator 4 of the accumulator 1 is displaced reducing the volume of its fluid reservoir 3 and forcing the fluid from it into the fluid power system via the fluid port 2. Due to maintaining small average distances between the gas and the heat exchange surfaces of the regenerating heat exchanger 10, the latter effectively returns the received part of heat to the gas. Thus, the device returns the fluid power received from the fluid power system back into it with reduced losses.

Due to the fact that the average size of the pores of the metal porous structure is at least 0.05 mm and the blocking element 11 deeply (preferably to the depth of at least 20% of the axial length of the receiver 9) penetrates into the regenerating heat exchanger 10, the gas-dynamic losses during gas flow between the accumulator and the receiver as well as through the metal porous structure of the regenerating heat exchanger 10 are small.

The blocking element 11 provided with a filtering element 12 prevents particles of the material of the regenerating heat exchanger 10 from passing into the gas line 7 and the gas reservoir 5 of the accumulator 1. Thus, the sliding seals of the piston separator 4 are protected from abrasive impact while the gas line 7 is protected from deposition of the particles, which increases reliability of the device.

The embodiments described above are examples of implementation of the main idea of the present invention that also contemplates a lot of other embodiments that are not described here in detail for example comprising several accumulators and receivers as well as various embodiments of a regenerating heat exchanger in the receiver.

Thus, the proposed solutions allow creation of a fluid power recuperation device with the following properties:

reduced heat losses and increased efficiency of fluid power recuperation;

better manufacturability;

possibility of using off-the-shelf gas receivers of any type in the device.

The invention claimed is:

1. Apparatus comprising:

a fluid power recuperator including:

at least one hydropneumatic accumulator, wherein the accumulator includes a fluid reservoir and a gas reservoir, wherein the accumulator includes a shell, wherein the shell contains a fluid port, wherein the fluid port communicates with the fluid reservoir, wherein the fluid port is configured to be operatively connected to a fluid power transfer system, wherein the fluid reservoir is separated from the gas reservoir by a movable separator, wherein the accumulator includes a first gas port, wherein the first gas port communicates with the gas reservoir;

a gas receiver, wherein the gas receiver includes a second gas port, wherein the first gas port of the accumulator communicates with the second gas port of the gas receiver, wherein the gas receiver contains a regenerating heat exchanger, wherein the regenerating heat exchanger is configured to receive heat generated by gas in the gas receiver from the transfer of energy from the fluid power transfer system to the fluid power recuperator, wherein the regenerating heat exchanger is configured to return heat to the gas in the gas receiver which causes fluid power to return to the fluid power system when energy returns from the fluid power recuperator into the fluid power system; and wherein an aggregate area of heat exchange surfaces of the regenerating heat exchanger over an aggregate internal receiver volume is greater than 2000 $cm^2$/liter.

2. The apparatus according to claim 1, wherein the regenerating heat exchanger includes a metal porous structure.

3. The apparatus according to claim 2, wherein the regenerating heat exchanger includes an aggregate volume of material in a range from 10% to 50% of an internal volume of the gas receiver.

4. The apparatus according to claim 1, wherein an aggregate area of heat exchange surfaces of the regenerating heat exchanger over an aggregate internal receiver volume is greater than 10,000 $cm^2$/liter.

5. The apparatus according to claim 2 wherein the metal porous structure includes metal cuttings.

6. The apparatus according to claim 2 wherein the metal porous structure includes metal wool.

7. The apparatus according to claim 2 wherein the metal porous structure includes metal foam.

8. The apparatus according to claim 2 wherein the average pore size does not exceed 5 mm.

9. The apparatus according to claim 8 wherein the average pore size is at least 0.05 mm.

10. The apparatus according to claim 2 wherein the average pore size is at least 0.05 mm.

11. The apparatus according to claim 1 and further including a blocking element, wherein the blocking element is in operative connection with the second gas port of the gas receiver, wherein the blocking element is configured to be permeable for gas but to prevent particles of material of the regenerating heat exchanger from passing into the gas reservoir via the second gas port.

12. The apparatus according to claim 11 wherein the blocking element extends axially in the gas receiver, wherein an axial length of the blocking element exceeds 20% of an axial length of the gas receiver.

13. The apparatus according to claim 1 wherein the regenerating heat exchanger includes components that form a structure, wherein the components that comprise the structure are loaded inside the gas receiver through the second first gas port of the gas receiver.

14. Apparatus comprising:

a regenerating heat exchanger for a gas receiver of a fluid power recuperator, wherein the regenerating heat exchanger is configured to receive heat generated by gas in the gas receiver from the transfer of energy from the fluid power transfer system to the fluid power recuperator, wherein the fluid power recuperator includes at least one hydropneumatic accumulator, wherein the accumulator includes a fluid reservoir and a gas reservoir, wherein the accumulator includes a shell, wherein the shell contains a fluid port, wherein the fluid port communicates with the fluid reservoir, wherein the fluid port is configured to be operatively connected to a fluid power transfer system, wherein the fluid reservoir is separated from the gas reservoir by a movable separator, wherein the accumulator includes a first gas port, wherein the first gas port communicates with the gas reservoir, wherein the gas receiver includes a second gas port, wherein the first gas port of the accumulator communicates with the second gas port of the gas receiver, wherein the regenerating heat exchanger is configured to return heat to the gas in the gas receiver which causes fluid power to return to the fluid power system when energy returns from the fluid power recuperator into the fluid power system, wherein an aggregate area of heat exchange surfaces of the regenerating heat exchanger over an aggregate internal receiver volume is greater than 2000 $cm^2$/liter.

15. The apparatus according to claim 14, wherein the regenerating heat exchanger comprises a metal porous structure.

16. The apparatus according to claim 15, wherein an aggregate volume of material of the regenerating heat exchanger is in a range from 10% to 50% of an internal volume of the gas receiver.

17. The apparatus according to claim 15 wherein the metal porous structure includes at least one of metal cuttings, metal wool, and metal foam.

18. The apparatus according to claim 15 wherein an average pore size of the metal porous structure is at least 0.05 mm and does not exceed 5 mm.

19. The apparatus according to claim 14 and further comprising the fluid power recuperator, wherein the fluid power recuperator includes the at least one hydropneumatic accumulator, wherein the accumulator includes the fluid reservoir and the gas reservoir, wherein the accumulator includes the shell, wherein the shell contains a fluid port, wherein the fluid port communicates with the fluid reservoir, wherein the fluid port is configured to be operatively connected to the fluid power transfer system, wherein the fluid reservoir is separated from the gas reservoir by the movable separator, wherein the accumulator includes the first gas port, wherein the first gas port communicates with the gas reservoir, wherein the gas receiver includes the second gas port, wherein the first gas port of the accumulator communicates with the second gas port of the gas receiver, wherein the regenerating heat exchanger includes components that comprise a structure, wherein the regenerating heat exchanger structure is positioned inside the gas receiver and includes the components of the heat exchanger loaded inside the gas receiver through the second first gas port of the gas receiver.

20. Apparatus comprising:

a gas receiver for a fluid power recuperator including:

a receiver shell, wherein the receiver shell includes a receiver interior area, a first gas port fluidly connected with the receiver interior area, wherein the fluid power recuperator includes at least one hydropneumatic accumulator, wherein the accumulator includes a fluid reservoir and a gas reservoir, wherein the accumulator includes an accumulator shell, wherein the accumulator shell is separate and disposed away from the receiver shell, wherein the shell contains a fluid port, wherein the fluid port communicates with the fluid reservoir, wherein the fluid port is configured to be operatively connected to a fluid power transfer system, wherein the fluid reservoir is separated from the gas reservoir by a movable separator, wherein the accumulator includes a second gas port, wherein the second gas port communicates with the gas reservoir, wherein the first gas port is configured to communicate with the second gas port of the accumulator; and a regenerating heat exchanger, wherein the regenerating heat exchanger includes components that comprise a structure, wherein the components of the regenerating heat exchanger structure are loaded inside the receiver interior area through the first gas port of the gas receiver, wherein the regenerating heat exchanger is configured to receive heat generated by gas in the gas receiver from the transfer of energy from the fluid power transfer system to the fluid power recuperator, wherein the regenerating heat exchanger is configured to return heat to the gas in the gas receiver which causes fluid power to return to the fluid power system when energy returns from the fluid power recuperator into the fluid power system.

21. The apparatus according to claim 20, wherein the heat exchanger structure includes a metal porous structure.

22. The apparatus according to claim 21, wherein the regenerating heat exchanger includes an aggregate volume of material in a range from 10% to 50% of an internal volume of the gas receiver, wherein an aggregate area of heat exchange surfaces of the regenerating heat exchanger over an aggregate internal receiver volume is greater than 2000 $cm^2$/liter.

23. The apparatus according to claim 20 and further comprising the fluid power recuperator, wherein the fluid power recuperator includes the at least one hydropneumatic accumulator, wherein the accumulator includes the fluid reservoir and the gas reservoir, wherein the accumulator includes the accumulator shell, wherein the accumulator shell contains the fluid port, wherein the fluid port communicates with the fluid reservoir, wherein the fluid port is configured to be operatively connected to the fluid power transfer system, wherein the fluid reservoir is separated from the gas reservoir by the movable separator, wherein the accumulator includes the second gas port, wherein the second gas port communicates with the gas reservoir, wherein the second gas port of the accumulator communicates with the first second gas port of the gas receiver, wherein an aggregate area of heat exchange surfaces of the regenerating heat exchanger over an aggregate internal receiver volume is greater than 2000 $cm^2$/liter, wherein the first gas port of the gas receiver is in operative connection with a blocking element, wherein the blocking element is configured to be permeable for gas but to prevent particles of material of the regenerating heat exchanger from passing into the gas reservoir via the second gas port.

* * * * *